US005472568A

United States Patent [19]

Mullen et al.

[11] Patent Number: 5,472,568

[45] Date of Patent: Dec. 5, 1995

[54] METHOD FOR CONTROLLING THE VISCOSITY OF KRAFT BLACK LIQUOR

[75] Inventors: Walter T. Mullen, Burlington, Canada; Vincent L. Magnotta, Wescosville, Pa.

[73] Assignee: Air Products and Chemicals, Inc., Allentown, Pa.

[21] Appl. No.: 117,465

[22] Filed: Sep. 7, 1993

[51] Int. Cl.[6] ..... D21C 11/04

[52] U.S. Cl. ..... 162/30.11; 162/29; 162/41; 162/65

[58] Field of Search ..... 162/29, 30.11, 162/41, 47, 65; 159/47.3

[56] References Cited

U.S. PATENT DOCUMENTS

| | | | |
|---|---|---|---|
| 4,239,589 | 12/1980 | Elton et al. | 162/29 |
| 4,313,788 | 2/1982 | Gulley | 162/31 |
| 4,718,978 | 1/1988 | Spannuth et al. | 162/29 |
| 4,929,307 | 5/1990 | Kiiskila et al. | 159/47.3 |
| 4,953,607 | 9/1990 | Erkki | 159/13.3 |

OTHER PUBLICATIONS

Rolf Ryham, "High Solids Evaporation Through Thermal Depol. of Black Liquor", 1989 Chem Rec.; pp. 157–160.

John R. Lavigne, "An Introduction to Paper Industry Instrumentation", 1977, pp. 198–199, 302–305.

Small, Jr. J. D. et al; "Thermal Stability of Kraft Black Liquor Viscosity at Elevated Temperatures"; *Ind. Eng. Chem Prod. RPS Div.;* 1985, 24, 608–614.

Hermans, et al; "The Effect of Oxidation on Black Liquor Composition and Properties" 1984 Pulping Cont; pp. 575–578.

*Primary Examiner*—David L. Lacey
*Assistant Examiner*—Dean T. Nguyen
*Attorney, Agent, or Firm*—John M. Fernbacher

[57] ABSTRACT

An improved method of chemical recovery from kraft black liquor is disclosed in which the heat generated by controlled oxidation of the liquor is utilized to reduce the viscosity and net heating value of the liquor which allows the firing of a more concentrated liquor in the recovery boiler. Net steam recovery is increased for a given black liquor feed rate. Alternatively, the firing of liquor having a higher solids concentration is possible, which increases the throughput of the recovery boiler.

6 Claims, 3 Drawing Sheets

METHOD FOR CONTROLLING THE VISCOSITY OF KRAFT BLACK LIQUOR

FIELD OF THE INVENTION

The present invention is directed toward the recovery of pulping chemicals from kraft black liquor, and particularly toward improved recovery methods which utilize oxygen to reduce the viscosity and net heating value of concentrated black liquor to increase recovery boiler capacity.

BACKGROUND OF THE INVENTION

The treatment of black liquor for recovery of pulping chemicals and heat value is an important and often limiting step in the kraft pulping process. Black liquor is a complex mixture of organic wood derivatives and alkaline pulping chemicals, chiefly containing degraded lignin, organic acid salts, resins, sodium hydroxide, and sodium salts including carbonate, sulfide, sulfate, sulfite, thiosulfate, and mercaptide. Weak black liquor typically contains 15 wt % dissolved and suspended solids of which about 80% are organic compounds and the remainder are inorganic compounds.

Weak black liquor is concentrated to about 45–50 wt % solids by multiple effect evaporation and further evaporated by direct contact evaporation to about 65 wt % solids. The concentrated liquor is combusted in a recovery boiler to raise steam and to recover sulfur and sodium for reuse in the pulping step. Oxidation of the sodium sulfide in the black liquor is necessary prior to the direct contact evaporator to minimize the emissions of hydrogen sulfide in the flue gas from the recovery boiler. Newer mills have replaced direct contact evaporators with indirectly-heated concentrators which eliminate total reduced sulfur emissions and yield higher liquor solids concentrations of up to 75 wt % before firing to the recovery boiler.

The capacity of the recovery boiler to combust black liquor and recover inorganic pulping chemicals often limits the production capacity of a pulp mill. The maximum capacity of the recovery boiler is typically limited by one or more parameters including fireside deposit formation, fume formation, and the maximum steam production rating of the boiler. Fireside deposit formation is caused by high temperatures in the pendant heat transfer surfaces of the boiler and high gas velocities from the furnace of the recovery boiler. Fume formation is caused by high temperatures in the furnace. The steam production rate at a constant firing rate of black liquor is a function of the available heat of the black liquor.

Increasing the solids concentration of the black liquor fired to the recovery boiler has several effects on the boiler operation. First, the fireside deposit formation rate is decreased due to decreased temperature and gas velocity of the gas from the furnace. At the same time, fume formation is increased by an increase in the temperature in the lower section of the furnace. Further, the steam production rate is increased due to the increased available heat of the black liquor. However, higher solids content black liquor has a higher viscosity which may cause operational problems in pumping and concentrating the liquor. Because of the benefits of increased steam production and lower fireside deposit formation rate, it is desirable to fire black liquor with the highest possible solids concentration. This upper limit of solids concentration is determined by allowable fume formation, pumpability of the liquor, and steam production rate limitations. The upper limit ranges between 63 and 80 wt % solids depending on the type and design of the recovery boiler.

The viscosity of black liquor can be reduced by heating in the absence of oxygen, which splits the lignin macromolecules contained in the liquor. U.S. Pat. No. 4,929,307 discloses a method for reducing viscosity by heating black liquor to 170°–190° C. and maintaining the liquor at this temperature for 1 to 60 minutes, preferably 1–5 minutes. U.S. Pat. No. 4,953,607 discloses a series of flash tanks and heat exchangers installed between the stages of a multiple effect evaporator wherein the liquor is heated indirectly to 190°–200° C. and held in a reactor vessel for 10–20 minutes to reduce the viscosity of the black liquor. The thermal stability and viscosity effects of temperature on black liquor are discussed in an article entitled "Thermal Stability of Kraft Black Liquor Viscosity at Elevated Temperatures" by J. D. Small et al in *Ind. Eng. Chem Prod. Res Dev.* 1985, 24, 608–614.

U.S. Pat. Nos. 4,239,589 and 4,313, 788 disclose the oxidation of black liquor in which high recovery of the heat of reaction is accomplished by integration with multiple effect evaporator stages. The extent of oxidation is controlled to oxidize the sodium sulfide in the liquor to sodium thiosulfate.

U.S. Pat. No. 4,718,978 discloses a method by which a portion of weak or partially concentrated black liquor is oxidized to a significant extent such that a substantial amount of the organic material is partially oxidized, and the oxidation is terminated just before the liquor becomes unpumpable. The oxidized liquor is blended with the remainder of the concentrated liquor and fed to the recovery boiler. The oxidation step significantly reduces the heat of combustion of the blended liquor.

Improved methods are needed to increase the efficiency of black liquor recovery and increase the capacity of recovery boilers in kraft pulp mills. In particular, methods are needed for handling the high solids liquor required for maximizing boiler capacity. The present disclosure and the claims which follow describe such an improved method.

SUMMARY OF THE INVENTION

The invention is an improved method for recovering pulping chemicals from kraft black liquor wherein black liquor is concentrated in a plurality of evaporation stages and fired in a recovery boiler to yield steam and smelt. The improvement comprises contacting the black liquor with an oxygen-containing gas to oxidize components in the black liquor at conditions sufficient to heat the liquor to a temperature above 350° F., and maintaining the liquor temperature above 350° F. for greater than one minute, whereby the net heating value of the liquor is decreased and the viscosity of the liquor is reduced without the addition of external heat, thereby allowing the concentration of the black liquor to a higher solids concentration in the evaporation stages prior to firing in the recovery boiler. The viscosity of the black liquor is thereby reduced permanently by utilizing the heat of reaction to increase the liquor temperature, and the net heating value is reduced by oxidation of selected black liquor components in the reactor. The desired viscosity of the black liquor can be controlled by controlling the liquid recycle rate to the reactor or by controlling the flow rate of the oxygen-containing gas to the reactor.

The present invention allows the firing of concentrated black liquor to the recovery boiler at higher solids content by decreasing operational problems caused by high liquor viscosity. In addition, the invention allows control of the gross heating value of the concentrated black liquor, which in turn allows the control of fume formation through the control of the lower furnace temperature. Steam production rate can be controlled by controlling the available heat of the black liquor. Thus the invention maximizes energy recovery from the black liquor and allows control of the rates of fireside deposit formation, fume formation, and boiler steam production.

DETAILED DESCRIPTION OF THE INVENTION

Figure 1:
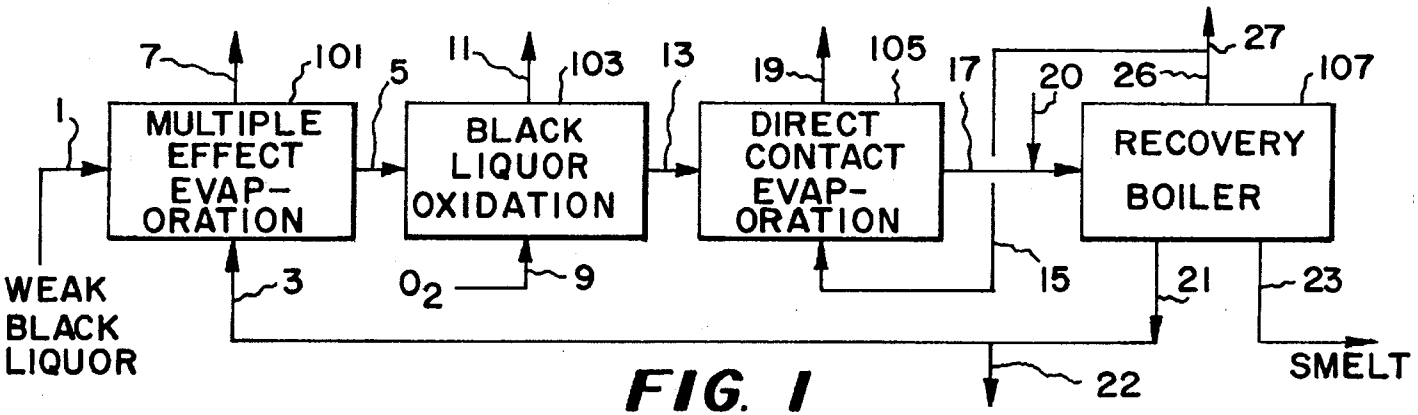
FIG. 1 (PRIOR ART)
FIG. 1 is a schematic flow diagram of a prior art method of black liquor concentration and combustion which utilizes direct contact evaporation prior to the recovery boiler.
Figure 2:
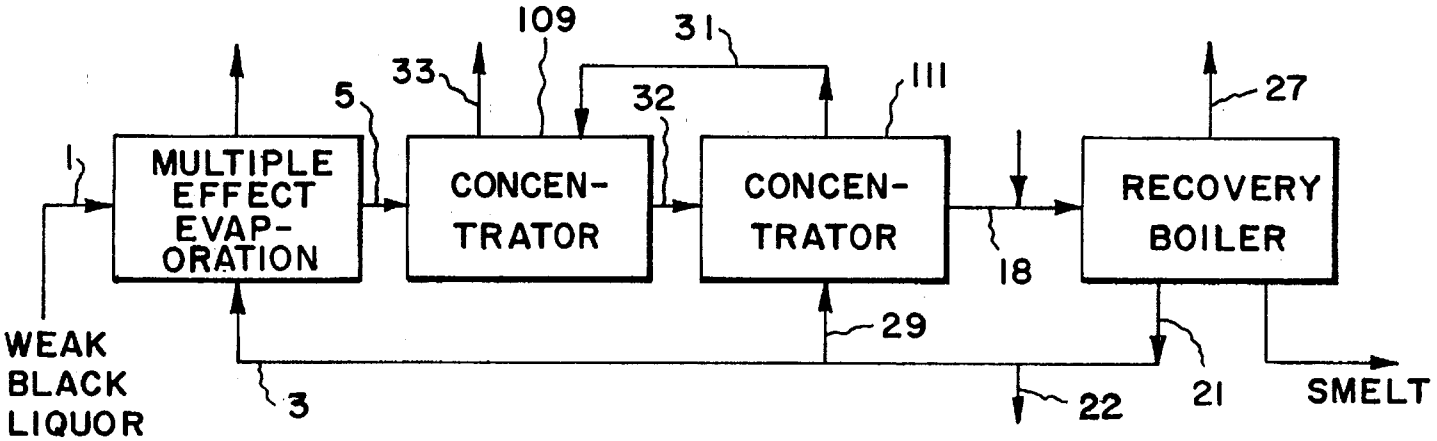
FIG. 2 (PRIOR ART)
FIG. 2 is a schematic flow diagram of a prior art method of black liquor concentration and combustion which utilizes indirectly heated concentrators prior to the recovery boiler.

The present invention can be understood by an initial review of the prior art process of FIGS. 1 and 2. Referring first to FIG. 1, weak black liquor 1 from the wood pulping and washing steps is fed to multiple effect evaporation system 101. Weak black liquor contains dissolved lignin and other wood constituents, sodium salts (particularly sodium sulfide and other unoxidized sulfur compounds), sodium hydroxide, and water. The liquor typically is at 160° F. and 20 psig, and typically contains 15 wt % solids. The liquor is concentrated in multiple effect evaporator system 101 heated by steam 3 as is known in the art to yield partially concentrated black liquor 5 and residual steam/condensate 7. Partially concentrated black liquor 5, typically at 230° F. and 15 psig containing 45 wt % solids, flows to black liquor oxidation system 103 in which oxygen-containing gas 9, which can be air, enriched air, or high purity oxygen containing up to 99.5 vol % $O_2$, oxidizes at least 95% of the sodium sulfide to sodium thiosulfate and optionally sodium sulfate. Vent gas 11 contains water vapor, unreacted oxygen, nitrogen, and possible volatile sulfur and organic compounds. Oxidized black liquor 13, now containing typically less than 2 g/l sodium sulfide, passes to direct contact evaporation system 105 in which the black liquor is further concentrated by direct contact with hot flue gas 15 from recovery boiler 107. Fully concentrated black liquor 17 and final flue gas 19 flow from evaporation system 105. The black liquor at this point typically contains 65 wt % solids at 240° F. Fully concentrated black liquor 17 is readily pumpable and is combined with sodium sulfate (salt cake) makeup 20 and passes into recovery boiler 107 in which the organic materials are combusted with air to generate heat withdrawn as steam 21 for use elsewhere in the mill. The inorganic sulfur, largely sodium thiosulfate, is reduced to sodium sulfide in the boiler and smelt 23 containing molten sodium sulfide and sodium carbonate is withdrawn for preparing green liquor. Flue gas streams 27 and 19 pass to a cleanup system for particulate removal, typically an electrostatic precipitator. The oxidation of sodium sulfide in black liquor oxidation system 103 is required in order to reduce the amount of hydrogen sulfide formed in direct contact evaporator 105 and carried therefrom to the atmosphere in final flue gas 19.

An alternate and improved prior art system utilized in modern kraft mills is illustrated in FIG. 2. Partially concentrated black liquor 5 is further concentrated by the use of indirectly-heated concentrators 109 and 111, in which evaporation heat is provided by steam 31 and 29. Final steam/condensate 33 is withdrawn therefrom. These concentrators are typically falling film, falling film crystallizer, or forced-circulation units as known in the art. Such concentrators have two important advantages over the older, direct contact evaporators: (1) a higher solids concentration in the black liquor, e.g., up to 80 wt % dry solids in liquor 18, is more easily attained, and (2) there is no contact between the liquor and the flue gas discharged to the atmosphere. The system as shown in FIG. 2 is commonly termed a "low-odor boiler" since sulfur-based odor discharges are greatly reduced or eliminated. The more modern black liquor concentration system of FIG. 2 does not require a black liquor oxidation step, and allows efficient operation of the recovery boiler with a high-solids feed.

Figure 3:
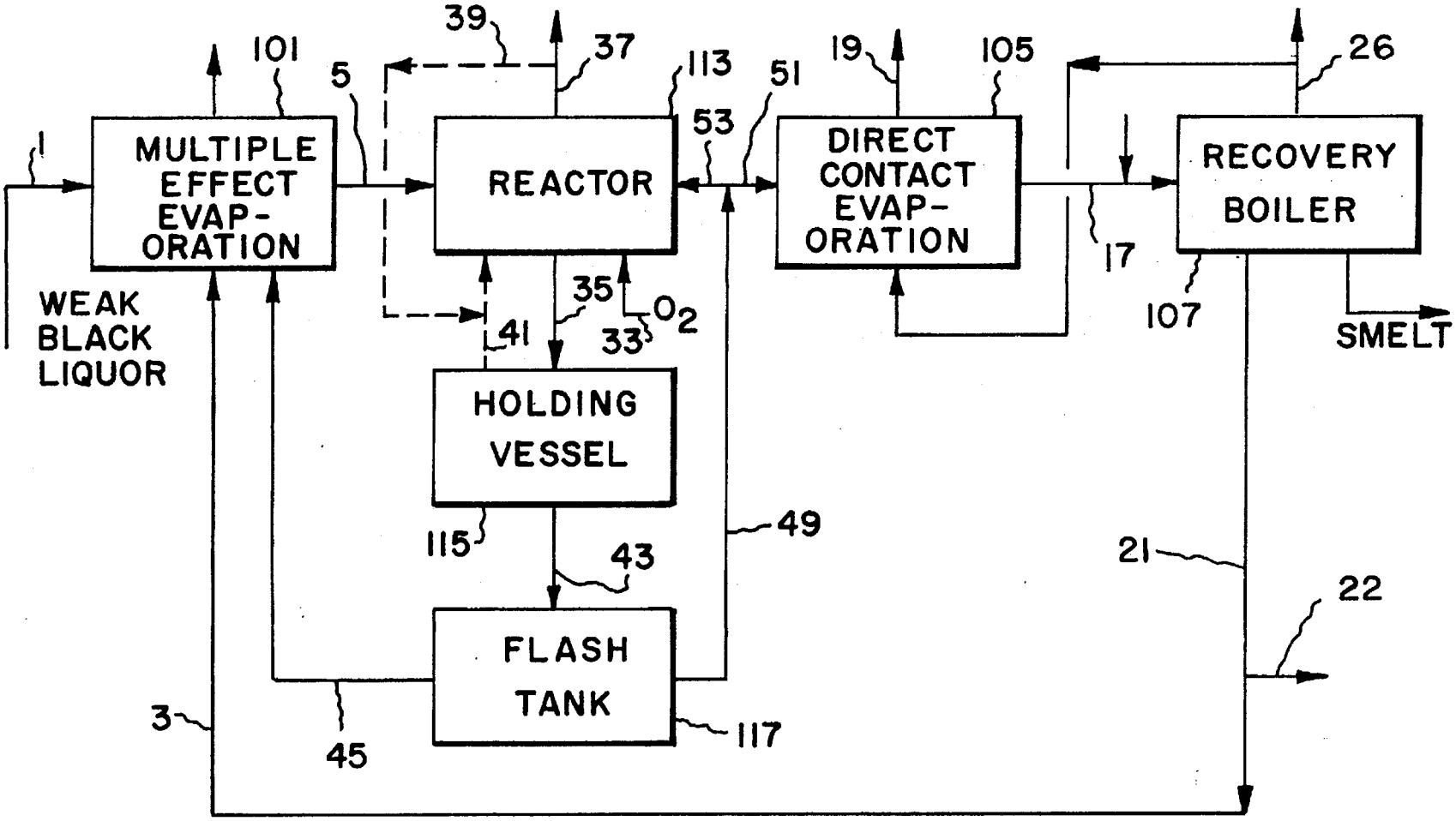
FIG. 3 is a schematic flow diagram of the present invention which is an improvement to the prior art method of black liquor concentration and combustion which utilizes direct contact evaporation prior to the recovery boiler.

The present invention comprises improvements to both of the prior art methods of FIGS. 1 and 2. One embodiment of the invention is illustrated in FIG. 3 and is an improvement of the process of FIG. 1. Partially concentrated black liquor 5 is contacted with oxygen-containing gas 33 in reactor 113 to promote the oxidation of sulfur compounds similar to the reactions occurring in black liquor oxidation reactor 103. The major reaction is the oxidation of sodium sulfide predominantly to sodium thiosulfate. Other sulfur species present at lower concentrations may participate in the oxidation reactions as well. Reactor 113 is operated at conditions of residence time and mixing intensity sufficient to achieve the desired degree of sulfide oxidation. Typically this requires a residence time of 1–2 minutes up to about 5 minutes, which is sufficient with proper mixing to oxidize up to 99% of the sulfide to thiosulfate. The reactor is operated so that the temperature of black liquor therein and the temperature of oxidized black liquor 35 is greater than 350° F., but should be limited to about 400° F. due to materials limitations if stainless steel is used for the reactor system.

Overoxidation of the black liquor may increase liquor viscosity and therefore must be avoided. Lignin exists in black liquor as a macromolecular colloid which is stabilized and kept in solution by ionized hydrophilic groups comprising phenolic hydroxyls and carboxyls. If the alkalinity (pH) of the liquor is decreased, the hydrophilic groups deionize and the lignin begins to associate, causing a significant increase in the liquor viscosity. Oxidation of black liquor reduces the alkali content (pH) of the liquor through the oxidation of alkali compounds and the formation of acids. The reactor should be operated such that there is sufficient alkali remaining in the black liquor to keep the hydrophilic groups in the ionized state thereby avoiding a significant increase in liquor viscosity. A significant increase in liquor viscosity is defined here as a viscosity increase of greater than about 30%.

The reactor utilizes mass transfer devices known in the art, e.g., spargers, agitators, and the like, to promote oxygen dissolution. Multiple stages can be utilized, if desired. Oxidized black liquor 35, having been heated by the exothermic oxidation reactions in reactor 113, flows to holding vessel 115 where the liquor is held at above 350° F. for greater than one minute and up to a maximum of about 60 minutes. During this holding period, the viscosity of the black liquor decreases due to thermal degradation of high molecular weight lignin compounds present therein. Significant viscosity reduction can be achieved as earlier discussed, and the actual reduction is a function of the temperature and holding time for a given black liquor. The effects of time and temperature vary with different black liquors, but increased temperature and longer holding time result in greater viscosity reduction for most black liquors. The essential feature of the invention is that the heat required to raise the liquor temperature for viscosity reduction is provided by the direct oxidation of components in the black liquor. This contrasts with the prior art described earlier in which heating is provided by direct steam, indirect steam, or electrical heating.

Holding vessel 115 may not be required for certain black liquors if the design of reactor 113 allows a sufficient holding time at the necessary temperature to achieve the desired viscosity reduction. For example, reactor 113 can be designed as a plug flow or pipeline reactor in which the oxygen is consumed in the initial portion of the reactor and the remaining portion of the reactor provides the required holding time at temperature for viscosity reduction. This alternative approach utilizes the essential feature of the invention described earlier, namely, that the heat required to raise the liquor temperature for viscosity reduction is provided by the direct oxidation of components in the black liquor.

An alternative reactor/holding vessel configuration may be required under certain conditions. The presence of sulfide appears to be required for certain black liquors for viscosity reduction during the holding period at temperature. In this situation, the degree of oxidation in reactor 113 is controlled so that a sufficient amount of residual sulfide is present in the liquor in holding vessel 115, and liquor 43 is subjected to an additional oxidation step to destroy residual sulfide (not shown) prior to flash tank 117.

Oxygen-containing gas 33 is preferably supplied as oxygen at least 90 vol % oxygen, and is obtained by cryogenic separation of air, vaporization of previously liquefied oxygen, pressure/vacuum swing adsorption, or permeable membrane systems. Reactor 113 and holding vessel 115 are typically operated in the pressure range of 100 to 300 psig. Reactor offgas 37 and offgas 41 from holding vessel 115 contain some volatile sulfur compounds and unreacted oxygen; these offgases can be incinerated, used as a source of sulfur in the pulping liquor, or recycled to reactor 113.

Oxidized and less-viscous black liquor 43 is flashed to a reduced pressure of 0 to 100 psig in flash tank 117; and flash vapor 45 comprising steam is used elsewhere for heating, for example as steam 45 to evaporator 101. The major portion 51 of flash tank liquor 49 passes to direct contact evaporator 105 or to a storage facility (not shown) prior to recovery boiler 107, and the process continues as described earlier regarding FIG. 1.

Optionally, portion 53 of flash tank liquor 49 is recycled to the reactor as necessary to moderate the reactor temperature and/or to control the residence time in holding vessel 115, which in turn affects the viscosity reduction of the black liquor. Thus, the recycle rate of liquor 53 can be used as a parameter to control the viscosity of concentrated black liquor at any downstream point, preferably the viscosity of concentrated black liquor 17 from direct contact evaporator 105. Alternately, the viscosity of flash tank liquor 49 can be a control parameter.

In one mode of operation, the functional relationship between the recycle rate of flash tank liquor 53 and the viscosity of black liquor 17 is determined experimentally. As the recycle rate of liquor 53 (which is cooler than the contents of reactor 113) is increased, the temperature and liquid residence time in reactor 113 will decrease if the rate of oxygen 33 remains constant, and the residence time in holding vessel 115 likewise will decrease. Changes in any of the upstream operating systems including the pulping system, evaporation system 101, and evaporation system 105 may affect the black liquor viscosity. In order to compensate for these changes and control the black liquor 17 viscosity at the desired value, the flow rate of flash liquor recycle 53 is adjusted to increase or decrease the temperature and residence times in reactor 113 and holding vessel 115. Typically, it is desired to control the viscosity of concentrated liquor 17 at a selected value such that no operational problems are encountered in the pump(s) feeding liquor to recovery boiler 107. The desired viscosity is controlled by determining the viscosity of liquor 17 at a given time, calculating the difference between this determined viscosity and the desired viscosity, and utilizing this difference with the previously determined functional relationship between flash liquor recycle 53 and the viscosity of liquor 17 to determine the necessary adjustment to liquor recycle 53. The viscosity of concentrated black liquor 17 is readily determined by standard laboratory methods or online viscosity measurement by mill operating personnel who then adjust the rate of flash liquor recycle 53 as ended based on the previously determined functional relationship between viscosity and recycle. These steps are repeated at an interval determined by mill experience. Alternately, the viscosity of black liquor 49 from flash tank 117 can be measured and used as the control parameter.

The process is controlled to yield a viscosity of black liquor 49 which is sufficient to avoid operational problems in any downstream centrifugal pumps, which typically operate with a low suction head. Typically the viscosity at the pump suction should be less than about 300 mPa sec to avoid pump problems.

A detailed description of the control method summarized above comprises reacting oxidizable black liquor components with an oxygen-containing gas in a reactor at conditions sufficient to increase the liquor temperature to above 350° F., wherein the liquor residence time in the reactor is less than five minutes. The degree of oxidation of the black liquor is controlled such that the stability of the colloidal lignin is not significantly reduced and hence the viscosity of the liquor is not increased significantly during oxidation. The liquor temperature is maintained in a holding vessel following the reactor at a temperature above 350° F. for greater than one minute, thereby permanently reducing the viscosity of the liquor. The reduced viscosity black liquor from the holding vessel is flashed in a flash tank at a pressure of typically between 0 and 100 psig, and a portion of the liquid from the flash tank is recycled to the reactor. Next, the functional relationship between the viscosity of the reduced viscosity black liquor and the flow rate of the liquid recycled from the flash tank to the reactor is determined. The desired value of the viscosity of the reduced viscosity black liquor is selected, the actual viscosity of this black liquor is measured, and the difference between the measured viscosity and the desired viscosity is calculated. This calculated difference is utilized with the determined functional relationship to correct the flow rate of the liquid recycled to the reactor, which in turn changes the liquor viscosity to the desired value. These steps are repeated at a first time interval which is selected based on the dynamic response characteristics of the oxidation reactor/flash tank system. The functional relationship between the viscosity of the reduced viscosity black liquor and the flow rate of the liquid recycled from the flash tank to the reactor is redetermined at a selected second time interval which is longer than the first time interval.

The flow rate of oxygen 33 is set to achieve the desired degree of oxidation of black liquor 5 consistent with the operating design of reaction 113. Oxygen is supplied at a rate which yields an oxygen to sodium sulfide molar ratio between 0.5 and 4.0. The reactor is typically operated to convert at least 99% of the sulfide to thiosulfate to control sulfur emissions from direct contact evaporator 105. The black liquor can be oxidized further, if necessary, to decrease the available heat from the black liquor to the recovery boiler as earlier described. Further oxidation is achieved by increasing the flow of oxygen 33 and/or increasing the residence time in reactor 113. However, any significant reduction of the alkali content in the black liquor should be avoided because such loss of alkali may destabilize the colloidal lignin and increase the viscosity of the black liquor, which negates the desired viscosity reduction in holding vessel 115. Oxidation of the organic fraction is tolerable as long as the colloidal lignin remains stable and the viscosity is not appreciably increased. Thus, the operation of reactor 113 at a residence time between one and five minutes at 350° F. to about 400° F. will oxidize inorganic sulfur compounds and minimize any significant reduction of alkali content which could increase liquor viscosity.

Alternatively, as discussed earlier, a different reactor/holding vessel configuration may be required under certain conditions. The presence of sulfide appears to be required for certain black liquors for viscosity reduction during the holding period at temperature. In this situation, the degree of oxidation in reactor 113 is controlled so that a sufficient amount of residual sulfide is present in the liquor in holding vessel 115, and liquor 43 is subjected to an additional oxidation step to destroy residual sulfide (not shown) prior to flash tank 117.

Thus in the embodiment of the invention described above with reference to FIG. 3 the oxidation of black liquor is integrated with the reduction of liquor viscosity by utilizing the heat of reaction directly to heat the liquor which is then held for the required time at temperature to accomplish the viscosity reduction. This feature differs from prior art methods earlier described which heat the black liquor using direct steam, indirect steam, or electrical heating.

The ability to control the degree to which black liquor is oxidized yields other benefits to the overall recovery process. By controlling the net heating value and thus the available heat from the black liquor, it is possible to:

(1) lower or maintain the rate of fireside deposit formation through a reduction in the temperature of the gases from the boiler and a reduction in the velocity of the gas from the furnace due to reduced combustion air requirements;

(2) lower or maintain the rate of fume formation by reducing the temperature in the furnace; and (3) reduce or maintain the steam production rate by controlling the available heat from the black liquor.

The available heat value from the black liquor can be determined from the gross heating value by making corrections for heat consumed by evaporating water, reducing sodium sulfate to sodium sulfide, and various other heat losses. The gross heating value is based on complete combustion of organic compounds and complete oxidation of sulfur compounds to sodium sulfate. As the solids concentration of the black liquor is increased, more available heat is generated per unit mass of black liquor feed because less water is present to absorb heat by vaporization. This will increase the temperature of the gases in the lower furnace, the fume formation rate, and the steam production rate. The additional fume formation or steam production may limit the black liquor solids firing rate to the boiler. By oxidizing the black liquor beyond the level required to control sulfur emissions, a further reduction in the heating value and thus the available heat from the black liquor can be realized which will offset the impact of the higher available heat associated with high solids liquor.

A key and unique feature of this embodiment of the invention is that both the net heating value and viscosity of the black liquor can be reduced by oxidizing the liquor and using the resulting heat of reaction to increase the liquor temperature for subsequent heat treating to reduce the viscosity. Further, the viscosity, solids concentration, and available heat of the black liquor can be controlled independently. An increase in the fume formation rate or steam production rate caused by an increase in solids concentration of the black liquor can be offset by controlling the degree to which the liquor is oxidized. Liquor can be fired with a higher solids concentration than would be possible with prior art liquor treatment.

Reactor 113 as shown in FIG. 3 is located between the multiple effect evaporation system 101 and direct contact evaporator 105, but reactor 113 alternatively can be located prior to one or more of the multiple effect evaporator stages of evaporation system 101. The location of reactor 113 will determine the liquor feed properties and thus affect the operation of the reactor. As earlier discussed, the reactor residence time and temperature must be controlled to allow desirable oxidation of inorganic sulfur compounds and minimize oxidation of organic constituents which would appreciably increase the liquor viscosity.

Figure 4:
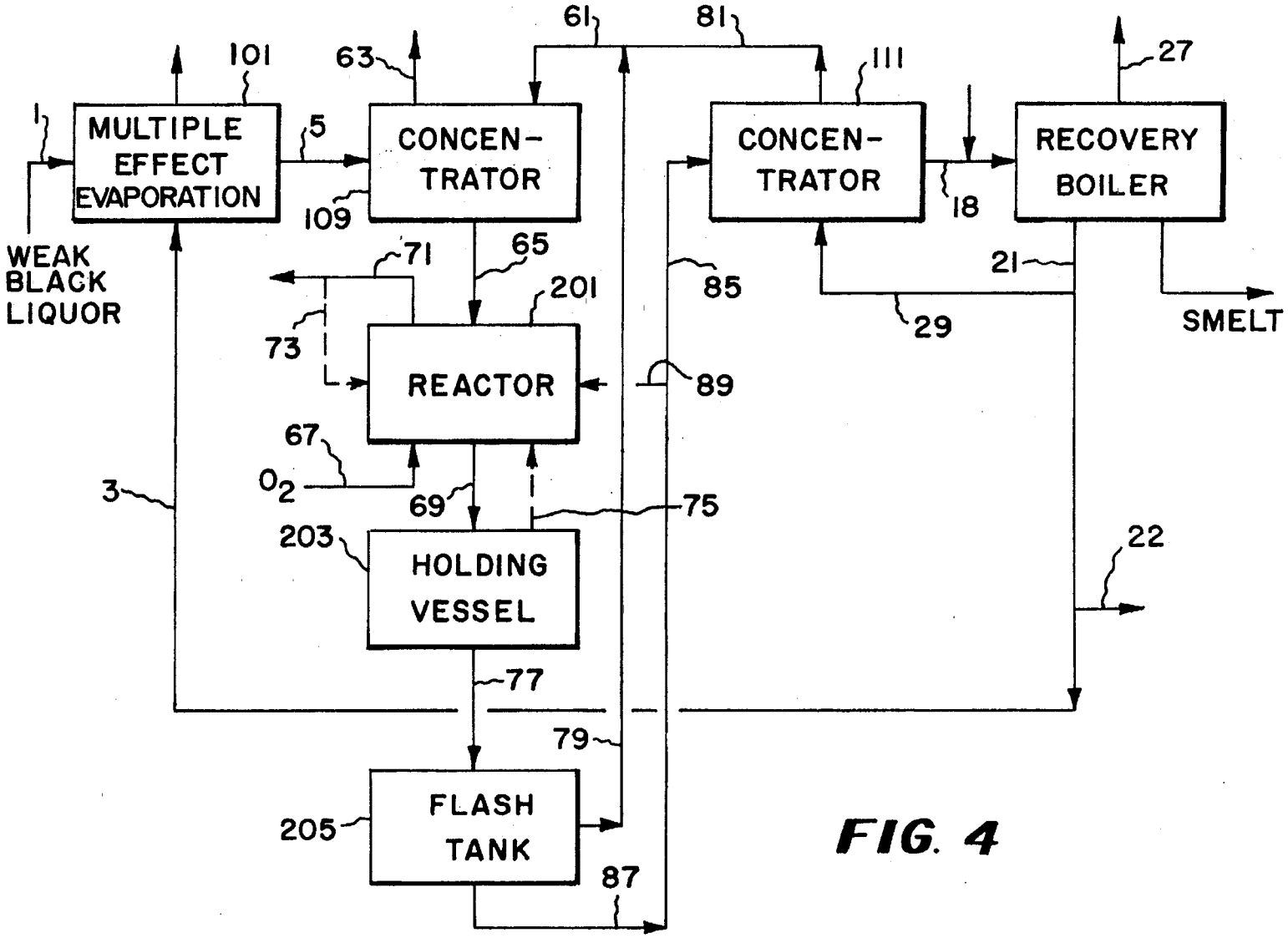
FIG. 4 is a schematic flow diagram of the present invention which is an improvement to the prior art method of black liquor concentration and combustion which utilizes indirectly heated concentrators prior to the recovery boiler.

An alternate embodiment of the present invention is illustrated in FIG. 4 which is an improvement to the prior art process of FIG. 2. Partially concentrated black liquor 5 from multiple effect evaporator 101 typically containing 50 wt % dry solids flows to concentrator 109 which is heated by steam 61. Water is evaporated and removed in stream 63 and further concentrated black liquor 65 typically containing 63 wt % dry solids is withdrawn therefrom. Concentrator 109 is a falling film, falling film crystallizer, or forced circulation type unit as known in the art which is designed to handle higher liquor solids concentration than multiple effect evaporation system 101. Further concentrated black liquor 65 is contacted with oxygen-containing gas 67 in reactor 201 to promote the oxidation of inorganic compounds, primarily sodium sulfide to sodium thiosulfate and sodium sulfate. Other sulfur species present at lower concentrations are also oxidized. Reactor 201 is operated typically at a residence time of 1–2 minutes and optionally up to 5 minutes. The reactor is operated so that the reactor outlet temperature and temperature of oxidized black liquor 69 is greater than 350° F. Generally, the maximum temperature should be about 400° F. The reactor should be operated such that no significant increase in liquor viscosity occurs as earlier discussed. The selections of residence time and flow rate of oxygen-containing gas 67 are determined by the desired degree of oxidation of the liquor and the temperature required in downstream processing. Heated oxidized black liquor 69, having been heated in situ by oxidation of liquor components, flows to holding vessel 203 where the liquor is held above 350° F. for greater than one minute and up to a maximum of about 60 minutes. During this holding period, the viscosity of the black liquor decreases permanently due to thermal degradation of high molecular weight lignin compounds present therein. Significant viscosity reduction can be achieved as earlier discussed, and the actual reduction is a function of the temperature and holding time for a given black liquor. The effects of time and temperature vary with different black liquors, but increased temperature and longer holding time result in greater viscosity reduction for most black liquors.

Oxygen gas 67 preferably supplied as at least 90 vol % oxygen, and is obtained by cryogenic separation of air, vaporization of previously liquefied oxygen, pressure/vacuum swing adsorption, or permeable membrane systems. Reactor 201 and holding vessel 203 are typically operated in the pressure range of 100 to 300 psig. Reactor offgas 71 and holding vessel offgas 75 contain some volatile sulfur compounds and unreacted oxygen; the offgases can be incinerated, recycled to reactor 210, or used as a source of sulfur in the pulping liquor.

Partially oxidized and reduced viscosity black liquor 77 is flashed to a reduced pressure of 0 to 100 psig in flash tank 205, and flash vapor 79 comprising steam is utilized for thermal energy in concentrator 109 or is used elsewhere. The major portion 86 of flash tank liquor 87 passes to concentrator 111 and the process continues as described earlier regarding FIG. 2.

Optionally, portion 89 of flash tank liquor 87 is recycled to the reactor as necessary to moderate the reactor temperature and/or to control the residence time in holding vessel 203, which in turn affects the viscosity reduction of the black liquor. Thus the recycle rate of liquor 89 can be used as a process variable to control the viscosity of concentrated black liquor at any downstream point, preferably the viscosity of concentrated black liquor 18 from concentrator 111. Alternatively the viscosity of flash tank liquor 87 can be used as the control parameter. In one mode of operation, the functional relationship between the recycle rate of flash tank liquor 87 and the viscosity of black liquor 18 is determined experimentally. As the recycle rate of liquor 89 (which is cooler than the contents of reactor 201) is increased, the temperature in reactor 201 will decrease if the rate of oxygen 67 remains constant, and the residence times in reactor 201 and holding vessel 203 likewise will decrease. Changes in any of the operating systems including the digestors, washers, evaporation system 101, and concentration 111 may affect the black liquor viscosity. In order to compensate for these changes and control the black liquor 18 viscosity at the desired value, the flow rate of flash liquor recycle 89 is adjusted to increase or decrease the temperature and residence time in reactor 201 and holding vessel 203. The viscosity is controlled by determining the viscosity of liquor 18 at a given time, calculating the difference between this determines viscosity and the desired viscosity, and utilizing this difference with the previously determined functional relationship between flash liquor recycle 89 and the viscosity of liquor 18 to determine the necessary adjustment to liquor recycle 89. The viscosity of concentrated black liquor 18 is readily determined by standard laboratory methods or by online viscosity measurement by mill operating personnel, who then adjust the rate of flash liquor recycle 89 as needed based on the previously determined functional relationship between viscosity and recycle rate. These steps are repeated at an interval determined by mill experience. The desired viscosity is selected such that no operational problems occur in pumping black liquor to the recovery boiler.

The operation of reactor 201 and holding vessel 203 are carried out in a similar manner to react 113 and holding vessel 115 of the previous embodiment. The maximum degree of oxidation in reactor 201 is such that the liquor viscosity is not increased significantly before flashing to holding vessel 203. In addition, the maximum degree of oxidation should not cause appreciable lignin precipitation. The minimum degree of oxidation in reactor 201 is that required to heat the liquor to the desired temperature for viscosity reduction. If necessary, reactor 201 can be operated to oxidize only a portion of the sulfide present, since sulfide removal of the previous embodiment is not necessary because the present embodiment does not utilize a direct contact evaporator. During certain operating periods, it may not be necessary to achieve high reduction of viscosity and liquor net heating value; during these periods, oxygen consumption can be reduced since sulfide removal otherwise is not needed.

In the previous embodiment of FIG. 3, the operation of reactor 113 and holding vessel 115 is primarily controlled to oxidize at least 99% of the sulfide present, and further oxidation is optional. Therefore, the rate of oxygen-containing gas 33 is set at least to yield the necessary sulfide removal. As flash tank liquid recycle is changed to control the viscosity changing holding vessel 115 residence time, the flow rate of oxygen-containing stream 33 is adjusted to meet the sulfide removal requirements. If further oxidation of the black liquor is desired in order to reduce the net heating value of recovery boiler feed liquor, flow of oxygen 33 is increased and recycle 53 is adjusted as needed to moderate the temperature of reactor 113.

In the present embodiment of FIG. 4, reactor 201 and holding vessel 203 can be operated at any conditions necessary to give the desired decreases in black liquor viscosity and net heating value of recovery boiler feed liquor. The only limitation in such operation is that the liquor in reactor 201 should not be over-oxidized to cause a significant increase in liquor viscosity, which negates the desired viscosity reduction in holding vessel 203. In addition, lignin precipitation caused by overoxidation should be avoided.

In one operating mode of the embodiment of FIG. 4, the viscosity of concentrated liquor 18 or partially concentrated liquor 85 is controlled by controlling the flow rate of flash tank liquid recycle 89 in a manner similar to the method described earlier for the embodiment of FIG. 3. In the present mode, flow of oxygen-containing gas 67 is set at a selected rate such that at the minimum anticipated flow of flash tank liquid recycle 89 is sufficient to control reactor temperature at the desired value. Alternate modes of controlling operating of the system of FIG. 4 are possible. For example, the viscosity of black liquor 18 or 85 can be controlled at a constant flow of flash tank liquid recycle 89 by controlling the flow rate of oxygen-containing gas 67, which in turn affects the degree of oxidation of liquor in reactor 201 and thus the temperature in holding vessel 203. As previously described, higher temperatures yield greater reduction in liquor viscosity in holding vessel 203. Since there is no required level of sulfide oxidation, oxygen-containing gas 67 can be set at any desired rate to control viscosity of liquors 18 or 85 at the desired value. In a parallel manner, the recovery boiler liquor net heating value can be controlled by controlling the flow rate of oxygen-containing gas 67. Increasing the degree of oxidation in reactor 201 will decrease the liquor net heating value as earlier described.

The maximum reduction in black liquor viscosity and net heating value is achieved by raising the oxygen rate via gas 67 and increasing the flow rate of flash tank liquid recycle 89 to optimum values consistent with the desired viscosity reduction while avoiding lignin precipitation.

A detailed description of the viscosity control method summarized above comprises reacting oxidizable black liquor components with an oxygen-containing gas in a reactor at conditions sufficient to increase the liquor temperature to above 350° F., wherein the liquor residence time in the reactor is less than five minutes and the degree of oxidation of the black liquor is controlled such that the viscosity of the liquor is not increased significantly during oxidation and lignin precipitation does not occur. The liquor temperature is maintained in a holding vessel following the reactor at a temperature above 350° F. for greater than one minute, thereby reducing the viscosity of the liquor. The reduced viscosity black liquor from the holding vessel is flashed in a flash tank, and a portion of the liquid from the flash tank may be recycled to the reactor. Next, the functional relationship between the viscosity of the reduced viscosity black liquor and the flow rate of the oxygen-containing gas to the reactor is determined. The desired value of the viscosity of the reduced viscosity black liquor is selected, the actual viscosity of this black liquor is measured, and the difference between the measured viscosity and the desired viscosity is calculated. This calculated difference is utilized with the determined functional relationship to correct the flow rate of the oxygen-containing gas to the reactor, which in turn changes the liquor viscosity to the desired value by affecting the temperature in the holding vessel. These steps are repeated at a first time interval which is selected based on the dynamic response characteristics of the oxidation reactor/flash tank system. The functional relationship between the viscosity of the reduced viscosity black liquor and the flow rate of the oxygen-containing gas to the reactor is redetermined at a selected second time interval which is longer than the first time interval.

EXAMPLE 1

A heat and material balance was carried out for the prior art process of FIG. 1 using a weak black liquor 1 containing 100 lb/hr of dissolved solids at a concentration of 15 wt %. Air is used for oxidation in reactor 103 and liquor 17 is concentrated to 65 wt % solids before firing to the recovery boiler. A stream summary for Example 1 is given in Table 1.

TABLE 1

| | STREAM INFORMATION FIG. 1 (PRIOR ART) | | | | | | | |
|---|---|---|---|---|---|---|---|---|
| STREAM NO. | 1 | 3 | 5 | 13 | 17 | 21 | 22 | 26 |
| Temperature, °F. | 160 | 298 | 230 | 230 | 240 | 470 | 470 | 575 |
| Total Solids, wt % | 15 | 0 | 45 | 50 | 65 | 0 | 0 | 0 |
| Flow Rates, lb/hr | | | | | | | | |
| Water | 567 | 91 | 120 | 100 | 54 | 520 | 429 | 92 |
| Solids | 100 | 0 | 100 | 100 | 100 | 0 | 0 | 0 |
| Gas (Excl. $H_2O$) | 0 | 0 | 0 | 0 | 0 | 0 | 0 | 536 |
| Total | 667 | 91 | 220 | 200 | 154 | 520 | 429 | 628 |

EXAMPLE 2

A heat and material balance was carried out for the embodiment of the present invention illustrated in FIG. 3 using the same weak black liquor feed as in Example 1, and a stream summary is given in Table 2. The black liquor is concentrated to 50 wt % solids prior to oxidation and is held at 400° F. for 5 minutes in holding vessel 115. Black liquor 17 is further concentrated to 75 wt % solids prior to firing in the recovery boiler.

TABLE 2

| | STREAM TEMPERATURE FIG. 3 (PRESENT INVENTION) | | | | | | | | | | |
|---|---|---|---|---|---|---|---|---|---|---|---|
| STREAM NO. | 1 | 3 | 5 | 17 | 21 | 22 | 26 | 33 | 43 | 45 | 49 |
| Temperature, °F. | 160 | 298 | 230 | 240 | 575 | 575 | 575 | 70 | 400 | 300 | 230 |
| Total Solids, wt % | 15 | 0 | 45 | 75 | 0 | 0 | 0 | 0 | 45 | 0 | 52 |
| Flow Rates, lb/hr | | | | | | | | | | | |
| Water | 567 | 70 | 120 | 33 | 555 | 485 | 71 | 0 | 120 | 27 | 93 |
| Solids | 100 | 0 | 100 | 100 | 0 | 0 | 0 | 0 | 100 | 0 | 100 |
| Gas (Excl. $H_2O$) | 0 | 0 | 0 | 0 | 0 | 0 | 536 | 4.0 | 0 | 0 | 0 |
| Total | 667 | 70 | 220 | 133 | 555 | 485 | 607 | 4.0 | 220 | 27 | 193 |

A comparison of Tables 1 and 2 shows that by utilizing the method of the present invention, which enables the firing of a higher solids liquor, the recovery boiler flue gas volume is reduced by 3.3% and the gross steam production from the boiler is increased by 6.7%. In addition, the net steam production from the boiler as BTU/lb of black liquor solids is increased by 18.6% in the present invention as seen by the steam balance of Table 3.

TABLE 3

| Steam Balance of Prior Art vs Present Invention (BTU/lb black liquor solids) | | | |
|---|---|---|---|
| | Prior Art (FIG. 1) | Present Invention (FIG. 3) | Difference |
| Steam from Boiler (gross) | 3927 | 4164 | 237 |
| Steam to Evaporator 101 | −1250 | −990 | 260 |

TABLE 3-continued

| Steam Balance of Prior Art vs Present Invention (BTU/lb black liquor solids) | | | |
|---|---|---|---|
| | Prior Art (FIG. 1) | Present Invention (FIG. 3) | Difference |
| Net Steam Production | 2677 | 3174 | 497 |

EXAMPLE 3

A heat and material balance was carried out for the prior art process of FIG. 2 using a weak black liquor 1 containing 100 lb/hr of dissolved solids at a concentration of 15 wt %. Black liquor oxidation is not required since the direct contact evaporator of Example 1 is replaced by concentrators 109 and 111. Liquor 18 is concentrated to 70 wt % solids before firing to the recovery boiler. A stream summary for Example 3 is given in Table 4.

TABLE 4

| STREAM INFORMATION FIG. 2 (PRIOR ART) | | | | | | | | |
|---|---|---|---|---|---|---|---|---|
| STREAM NO. | 1 | 3 | 5 | 18 | 21 | 22 | 27 | 29 |
| Temperature, °F. | 160 | 298 | 280 | 260 | 470 | 470 | 350 | 298 |
| Total Solids, wt % | 15 | 0 | 50 | 70 | 0 | 0 | 0 | 0 |
| Flow Rates, lb/hr | | | | | | | | |
| Water | 567 | 91 | 100 | 42 | 622 | 495 | 81 | 36 |
| Solids | 100 | 0 | 100 | 100 | 0 | 0 | 0 | 0 |
| Gas (Excl. $H_2O$) | 0 | 0 | 0 | 0 | 0 | 0 | 550 | 0 |
| Total | 667 | 91 | 200 | 142 | 622 | 495 | 631 | 36 |

EXAMPLE 4

A heat and material balance was carried out for the embodiment of the present invention illustrated in FIG. 4 using the same weak black liquor feed as in Example 3, and a stream summary is given in Table 5. The black liquor is concentrated to 63 wt % solids prior to oxidation and is held at 350° F. for 5 minutes in holding vessel 203. Black liquor 85 is further concentrated to 84 wt % solids (stream 18) prior to firing in the recovery boiler.

TABLE 5

| STREAM INFORMATION FIG. 4 (PRESENT INVENTION) | | | | | | | | | | | | | |
|---|---|---|---|---|---|---|---|---|---|---|---|---|---|
| STREAM NO. | 1 | 3 | 5 | 18 | 21 | 22 | 27 | 29 | 65 | 67 | 69 | 79 | 85 |
| Temperature, °F. | 160 | 298 | 280 | 260 | 470 | 470 | 350 | 298 | 280 | 70 | 350 | 260 | 260 |
| Total Solids, wt % | 15 | 0 | 50 | 84 | 0 | 0 | 0 | 0 | 63 | 0 | 63 | 0 | 65 |
| Flow Rates, lb/hr | | | | | | | | | | | | | |
| Water | 557 | 91 | 100 | 19 | 647 | 514 | 57 | 42 | 59 | 0 | 59 | 8 | 51 |
| Solids | 100 | 0 | 100 | 100 | 0 | 0 | 0 | 0 | 100 | 0 | 100 | 0 | 100 |
| Gas (Excl. $H_2O$) | 0 | 0 | 0 | 0 | 0 | 0 | 546 | 0 | 0 | 1.2 | 0 | 0 | 0 |
| Total | 667 | 91 | 200 | 119 | 647 | 514 | 603 | 42 | 159 | 1.2 | 159 | 8 | 151 |

A comparison of Tables 4 and 5 shows that by utilizing the method of the present invention, which enables the firing of a higher solids liquor, the gross steam production from the boiler is increased by 4.0 %. In addition, the net steam recovery from the boiler as BTU/lb of black liquor solids is increased by 6.1% in the present invention over the prior art as seen by the steam balance of Table 6.

TABLE 6

| Steam Balance of Prior Art vs Present Invention (BTU/lb black liquor solids) | | | |
|---|---|---|---|
| | Prior Art (FIG. 2) | Present Invention (FIG. 4) | Difference |
| Steam from Boiler (gross) | 4670 | 4853 | 183 |
| Steam from Concentrator 109 | 273 | 377 | 104 |
| Steam to Evaporator 101 | −864 | −864 | 0 |
| Steam to Concentrator 111 | −342 | −399 | −57 |
| Net Steam Production | 3737 | 3967 | 230 |

The key and unique feature of the first embodiment of the invention, in which liquor is concentrated in a direct contact evaporator, is that the net heating value and viscosity of the black liquor are both reduced by oxidizing the liquor at operating conditions such that at least 99% of the sulfide is destroyed without a significant increase in liquor viscosity due to oxidation of the organic components in the liquor. The resulting heat of reaction is utilized to heat the liquor for subsequent heat treating to reduce the viscosity. In the alternate embodiment of the invention in which concentrators replace the direct contact evaporator, there is no requirement for sulfide oxidation, and the degree of liquor oxidation can be selected as desired. Liquor can be fired with an even higher solids concentration than in the previous embodiment. Alternatively, the reduction in liquor heating value and viscosity allow the firing of liquor having a higher solids concentration, which increases the capacity of a recovery boiler to process black liquor when the boiler capacity is limited by fouling of the pendant heat transfer surfaces.

The essential characteristics of the present invention are described completely in the foregoing disclosure. One skilled in the art can understand the invention and make various modifications thereto without departing from the basic spirit thereof, and without departing from the scope of the claims which follow.

We claim:

1. A method for controlling the viscosity of kraft black liquor which comprises:

a) reacting components in said black liquor with an oxygen-containing gas in a reaction zone at conditions sufficient to increase the liquor temperature to above 350° F. while avoiding a significant increase in liquor viscosity;

(b) maintaining the liquor temperature in a holding zone at a temperature above 350° F. for greater than one minute, thereby reducing the viscosity of the liquor;

c) flashing the reduced viscosity black liquor from said holding zone in a flash zone tank at a reduced pressure to yield liquor and vapor streams;

d) recycling a portion of the liquor from said flash zone tank to said reaction zone;

(e) determining the functional relationship between the viscosity of said reduced viscosity black liquor and the flow rate of the liquor recycled from said flash zone tank to said reaction zone;

(f) selecting a desired value of the viscosity of said reduced viscosity black liquor;

(g) measuring the viscosity of said reduced viscosity black liquor;

(h) determining the difference between the measured viscosity of step (g) and the desired viscosity of step (f);

(i) utilizing said difference and said functional relationship of step (e) to correct the flow rate of the liquor recycled to said reaction zone in step (d); and (j) repeating steps (g), (h), and (i) at a first time interval to control the viscosity of said reduced viscosity black liquor.

2. The method of claim 1 which further comprises repeating step (e) at a second time interval greater than said first time interval.

3. The method of claim 1 which further comprises concentrating said black liquor to a dry solids concentration of between 20 and 75 wt % prior to said reaction zone.

4. A method for controlling the viscosity of kraft black liquor which comprises:

(a) reacting components in said black liquor with an oxygen-containing gas in a reaction zone at conditions sufficient to increase the liquor temperature to above 350° F. while avoiding a significant increase in liquor viscosity;

(b) maintaining the liquor temperature in a holding zone at a temperature above 350° F. for greater than one minute, thereby reducing the viscosity of the liquor;

(c) flashing the reduced viscosity black liquor from said holding zone in a flash zone tank at a reduced pressure to yield liquor and vapor streams;

(d) recycling a portion of the liquor from said flash zone tank to said reaction zone;

(e) determining the functional relationship between the viscosity of said reduced viscosity black liquor and the flow rate of the liquor recycled from said flash zone tank to said reaction zone;

(f) selecting the desired value of the viscosity of said reduced viscosity black liquor;

(q) measuring the viscosity of said reduced viscosity black liquor;

(h) determining the difference between the measured viscosity of step (g) and the desired viscosity of step (f);

(i) utilizing said difference and said functional relationship of step (e) to correct the flow rate of said oxygen-containing gas to said reaction zone in step (a); and (j) repeating steps (g), (h), and (i) at a first time interval to control the viscosity of said reduced viscosity black liquor.

5. The method of claim 4 which further comprises repeating step (e) at a second time interval greater than said first time interval.

6. The method of claim 4 which further comprises concentrating said black liquor to a dry solids concentration of between 20 and 75 wt % prior to said reaction zone.

* * * * *